US008808501B2

(12) United States Patent
Vinson et al.

(10) Patent No.: US 8,808,501 B2
(45) Date of Patent: Aug. 19, 2014

(54) METHODS FOR INDIVIDUALIZING TRICHOMES

(71) Applicant: The Procter & Gamble Company, Cincinnati, OH (US)

(72) Inventors: Kenneth Douglas Vinson, Toone, TN (US); Teresa Jean Franklin, Saline, MI (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/934,361

(22) Filed: Jul. 3, 2013

(65) Prior Publication Data

US 2013/0299111 A1 Nov. 14, 2013

Related U.S. Application Data

(60) Division of application No. 13/629,845, filed on Sep. 28, 2012, now Pat. No. 8,623,176, which is a continuation of application No. 13/251,552, filed on Oct. 3, 2011, now Pat. No. 8,297,543, which is a continuation of application No. 12/851,923, filed on Aug. 6, 2010, now Pat. No. 8,056,841, which is a division of application No. 11/436,494, filed on May 18, 2006, now Pat. No. 7,811,613.

(60) Provisional application No. 60/693,335, filed on Jun. 23, 2005.

(51) Int. Cl.

| | |
|---|---|
| ***D21H 11/12*** | (2006.01) |
| ***A01H 5/00*** | (2006.01) |
| ***D21F 11/00*** | (2006.01) |
| *D21H 27/00* | (2006.01) |

(52) U.S. Cl.

CPC ..... *D21F 11/00* (2013.01); *D21H 27/002* (2013.01); *D21H 11/12* (2013.01)

USPC ..... 162/148; 162/117; 800/323; 800/278

(58) Field of Classification Search

CPC ..... D21H 11/12; D21H 11/14; D21H 27/30; D21H 27/38; A01H 5/00; A01H 5/12; A01H 5/02; A61K 8/0208; B32B 5/26

USPC ..... 162/148, 117; 241/24.1; 428/172, 428/292.1; 424/745; 800/323, 278

See application file for complete search history.

(56) References Cited

U.S. PATENT DOCUMENTS

| | | | | |
|---|---|---|---|---|
| 717,050 | A * | 12/1902 | Strehli | 106/165.01 |
| 2,663,907 | A | 12/1953 | Downing et al. | |
| 2,729,560 | A | 1/1956 | House et al. | |
| 3,097,127 | A | 7/1963 | Ostmann, Jr. | |
| 3,301,746 | A | 1/1967 | Sanford et al. | |
| 3,353,682 | A | 11/1967 | Pall et al. | |
| 3,382,140 | A | 5/1968 | Henderson et al. | |
| 3,573,094 | A | 3/1971 | Anspon et al. | |
| 3,723,231 | A | 3/1973 | Clay et al. | |
| 3,794,558 | A | 2/1974 | Back et al. | |
| 3,825,381 | A | 7/1974 | Dunning et al. | |
| 3,949,035 | A | 4/1976 | Dunning et al. | |
| 3,974,025 | A | 8/1976 | Ayers | |
| 3,994,771 | A | 11/1976 | Morgan, Jr. et al. | |
| 4,087,316 | A | 5/1978 | Jividen et al. | |
| 4,100,324 | A | 7/1978 | Anderson et al. | |
| 4,191,609 | A | 3/1980 | Trokhan | |
| 4,257,842 | A | 3/1981 | Ciaccia et al. | |
| 4,261,139 | A | 4/1981 | Pogue | |
| 4,300,981 | A | 11/1981 | Carstens | |
| 4,637,859 | A | 1/1987 | Trokhan | |
| 5,437,908 | A | 8/1995 | Demura et al. | |
| H1672 | H | 8/1997 | Hermans et al. | |
| 5,797,550 | A | 8/1998 | Woodall et al. | |
| 5,846,380 | A | 12/1998 | Van Phan et al. | |
| 5,856,006 | A | 1/1999 | Asai et al. | |
| 6,017,833 | A * | 1/2000 | Reiner et al. | 442/408 |
| 6,068,732 | A | 5/2000 | Cassidy et al. | |
| 6,149,769 | A | 11/2000 | Mohammadi et al. | |
| 6,163,943 | A | 12/2000 | Johansson et al. | |

(Continued)

FOREIGN PATENT DOCUMENTS

| | | | |
|---|---|---|---|
| CA | 1036304 | A | 8/1978 |
| EP | 1 548 165 | A1 | 6/2005 |

(Continued)

OTHER PUBLICATIONS

Compton. "Upper North Wakashan and Southern Timishian Ethnobotany: The Knowledge and Usage of Plants and Fungi Among the Oweekeno, Hanaksiala (Kitlope and Kemano), Haisla (Kitamaat) and Kitasoo Peoples of the Central and North Coasts of British Columbia", *The University of British Columbia, Ph.D. Thesis*, p. 256 (1993).

Kim, et al., "Cotton Fiber Growth In Planta and In Vitro, Models for Plant Cell Elongation and Cell Wall Biogenesis", *Plant Physiology*, vol. 127, pp. 1361-1366 (2001).

Kuhlein, et al., WSDOT-Ethnobotany-Herbs [Online] 1991-1994 XP002406397; retrieved from the Internet; URL:http://www.wsdot.wa.gov/Environment/CulRes/herbs.htm#Typha (retrieved on Nov. 9, 2006) Abstract, 1page.

Potikha, et al. "A Mutant of *Arabidopsis thaliana* Displaying Altered Patterns of Cellulose Deposition", *Plant Journal*, vol. 7, No. 3, pp. 453-460 (No. 3.) (1995).

(Continued)

*Primary Examiner* — June Hwu

(74) *Attorney, Agent, or Firm* — Wednesday G. Shipp; Sarah M. DeCristofaro

(57) ABSTRACT

A method for individualizing a trichome from an epidermis of a non-seed portion of a trichome-bearing plant in the Asteraceae family and Melastomataceae family to form a fibrous structure is provided. The method comprises contacting the plant with a device to separate the trichome from the epidermis and incorporating the separated trichome into fibrous structure.

4 Claims, 6 Drawing Sheets

(56) References Cited

U.S. PATENT DOCUMENTS

| | | | | |
|---|---|---|---|---|
| 6,613,954 | B1 | 9/2003 | Horney et al. | |
| 6,761,798 | B2 | 7/2004 | Altheimer et al. | |
| 7,217,339 | B2 | 5/2007 | Mohammadi et al. | |
| 7,691,233 | B2 | 4/2010 | Barcus et al. | |
| 7,691,472 | B2 | 4/2010 | Vinson et al. | |
| 7,811,613 | B2 | 10/2010 | Vinson et al. | |
| 7,838,725 | B2 | 11/2010 | Noda et al. | |
| 8,029,645 | B2 | 10/2011 | Mohammadi | |
| 8,056,841 | B2 | 11/2011 | Vinson et al. | |
| 8,297,543 | B2 | 10/2012 | Vinson et al. | |
| 8,425,722 | B2 | 4/2013 | Mohammadi | |
| 2001/0051796 | A1 | 12/2001 | Noda et al. | |
| 2003/0000666 | A1 | 1/2003 | Mansson et al. | |
| 2003/0093051 | A1 | 5/2003 | Malowaniec et al. | |
| 2004/0084164 | A1 | 5/2004 | Shannon et al. | |
| 2004/0084167 | A1 | 5/2004 | Vinson et al. | |
| 2004/0093696 | A1* | 5/2004 | Eisfeld | 19/6 |
| 2004/0154763 | A1 | 8/2004 | Polat et al. | |
| 2004/0163785 | A1 | 8/2004 | Shannon et al. | |
| 2004/0231810 | A1 | 11/2004 | Rousu et al. | |
| 2005/0091811 | A1 | 5/2005 | Billgren et al. | |
| 2005/0123733 | A1 | 6/2005 | Altheimer | |
| 2005/0123734 | A1 | 6/2005 | Altheimer | |
| 2005/0126726 | A1 | 6/2005 | Altheimer | |
| 2005/0238699 | A1 | 10/2005 | Kleinwaechter | |
| 2005/0279470 | A1 | 12/2005 | Redd et al. | |
| 2006/0108082 | A1 | 5/2006 | Bogdanski et al. | |
| 2006/0137842 | A1 | 6/2006 | Garnier et al. | |
| 2006/0288639 | A1 | 12/2006 | Vinson et al. | |
| 2007/0011762 | A1 | 1/2007 | Vinson et al. | |
| 2007/0056702 | A1 | 3/2007 | Altheimer | |
| 2007/0095491 | A1 | 5/2007 | Altheimer | |
| 2007/0107863 | A1 | 5/2007 | Edwards et al. | |
| 2007/0137812 | A1 | 6/2007 | Shannon et al. | |
| 2007/0255010 | A1 | 11/2007 | Barcus et al. | |
| 2007/0286894 | A1 | 12/2007 | Marsh et al. | |
| 2008/0003435 | A1 | 1/2008 | Trueman et al. | |
| 2008/0078516 | A1 | 4/2008 | Altheimer et al. | |
| 2008/0257512 | A1 | 10/2008 | Liu et al. | |
| 2009/0054858 | A1 | 2/2009 | Cheng et al. | |
| 2009/0269594 | A1 | 10/2009 | Vinson et al. | |
| 2011/0061825 | A1 | 3/2011 | Li et al. | |
| 2011/0168342 | A1 | 7/2011 | Mohammadi | |
| 2011/0226430 | A1 | 9/2011 | Mohammadi | |
| 2012/0006501 | A1 | 1/2012 | Golfman | |
| 2012/0090112 | A1 | 4/2012 | Carrier et al. | |
| 2012/0090113 | A1 | 4/2012 | Manifold et al. | |
| 2012/0090119 | A1 | 4/2012 | Carrier et al. | |
| 2013/0025808 | A1 | 1/2013 | Vinson et al. | |

FOREIGN PATENT DOCUMENTS

| | | | |
|---|---|---|---|
| JP | 2012081760 | A | 4/2012 |
| WO | WO 96/12849 | A1 | 5/1996 |
| WO | WO 00/59439 | A1 | 10/2000 |
| WO | WO 00/78127 | A1 | 12/2000 |
| WO | WO 01/52911 | A2 | 7/2001 |
| WO | WO 03/000990 | A1 | 1/2003 |
| WO | WO 2006/009991 | A1 | 1/2006 |
| WO | WO 2006/137041 | A3 | 12/2006 |
| WO | WO 2007/091216 | A1 | 8/2007 |
| WO | WO 2008/010187 | A2 | 1/2008 |
| WO | WO 2008/050311 | A2 | 5/2008 |
| WO | WO 2009/070955 | A1 | 6/2009 |

OTHER PUBLICATIONS

Riley, et al., "The Mbeere in Kenya", vol. II, Botanical Identities and Uses, pp. 50-51 and 102-103 (1988).

Tan: "Cattails (*Typha augustifolia*") [Online] 2001, XP002406398; retrieved from the Internet: URL:http:/www.naturia.per.sg/buloh/plants/cattail.html (retrieved on Nov. 9, 2006) Whole Documents, specialty uses, 2pp.

Zhang, et al., "A Simple and Efficient Method for Isolating Trichomes for Downstream Analyses", *Plant and Cell Physiology*, vol. 45, No. 2, pp. 221-224 (Feb. 2004) XPOO2409939.

*The New Royal Horticultural Society Dictionary of Gardening*, vol. 4, p. 359 (1992).

Definition of trichome [online], [retrieved on Apr. 14, 2009], Retrieved from the Internet www.yourdictionary.com/trichome, one page.

All Office Actions for U.S. Appl. No. 11/894,519.

All Office Actions for U.S. Appl. No. 13/118,934.

* cited by examiner

METHODS FOR INDIVIDUALIZING TRICHOMES

FIELD OF THE INVENTION

The present invention relates to individualized trichomes, methods for individualizing trichomes, trichome-containing fibrous structures, single- or multi-ply sanitary tissue products comprising such fibrous structures and methods for making such fibrous structures and sanitary tissue products.

BACKGROUND OF THE INVENTION

Formulators of cellulose chemicals and fibrous structures are always looking for additional natural sources (chemicals and/or fibers) in order to improve performance or reduce cost.

Fibrous structures have conventionally been made with wood pulp cellulosic fibers. More recently, synthetic fibers have been used.

No prior art reference has disclosed liberating trichomes to obtain individualized trichomes and using trichomes in fibrous structures.

Accordingly, there is a need for individualized trichomes, methods for individualizing trichomes, trichome-containing fibrous structures, single- or multi-ply sanitary tissue product comprising such fibrous structures and methods for making such fibrous structures and sanitary tissue products.

SUMMARY OF THE INVENTION

The present invention fulfills the needs described above by providing individualized trichomes, methods for individualizing trichomes, a trichome-containing fibrous structure, single- or multi-ply sanitary tissue product comprising such a fibrous structure and methods for making such fibrous structures and sanitary tissue products.

In one example of the present invention, an individualized trichome is provided.

In another example of the present invention, a chemical derivative of an individualized trichome is provided.

In another example of the present invention, a fibrous structure comprising a trichome is provided.

In another example of the present invention, a single- or multi-ply sanitary tissue product comprising a fibrous structure according to the present invention is provided.

In another example of the present invention, a mechanical method for individualizing a trichome is provided.

In another example of the present invention, a chemical method for individualizing a trichome is provided.

In yet another example of the present invention, a method for making a fibrous structure according to the present invention is provided.

In still another example of the present invention, a method for making a single- or multi-ply sanitary tissue product comprising a fibrous structure according to the present invention is provided.

In even yet another example, a method for making a trichome-containing fibrous structure comprising the steps of:

a) preparing a fiber furnish (slurry) by mixing a trichome with water;

b) depositing the fiber furnish on a foraminous forming surface to form an embryonic fibrous web; and c) drying the embryonic fibrous web, is provided.

Accordingly, the present invention provides an individualized trichome, a method for individualizing trichomes, a trichome-containing fibrous structure, a single- or multi-ply sanitary tissue product comprising such a fibrous structure and methods for making such fibrous structures and sanitary tissue products.

DETAILED DESCRIPTION OF THE INVENTION

Definitions

Figure 1:
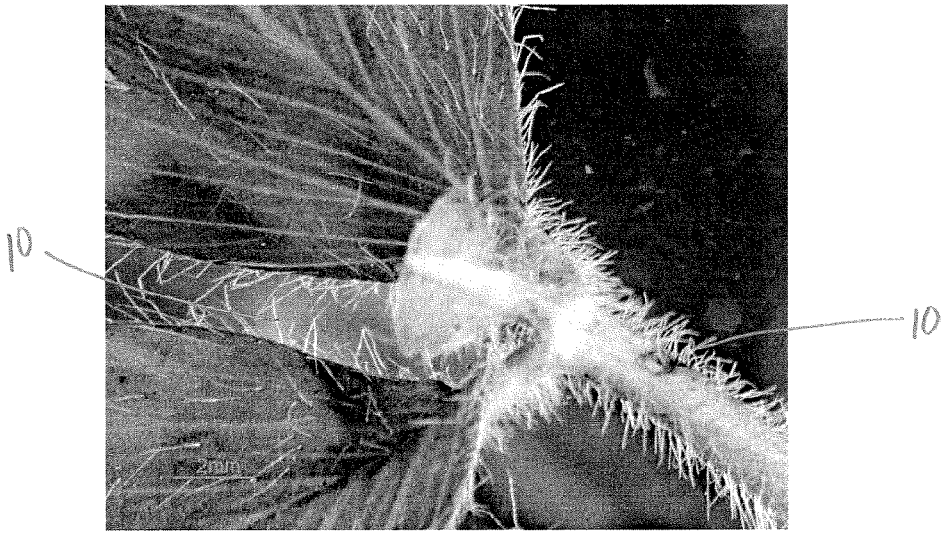
FIG. 1 is a light micrograph of a leaf and leaf stem illustrating trichomes present on red clover, *Trifolium pratense* L.

"Trichome" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristlelike outgrowth from the epidermis of a plant.

Trichomes may protect the plant tissues present on a plant. Trichomes may for example protect leaves and stems from attack by other organisms, particularly insects or other foraging animals and/or they may regulate light and/or temperature and/or moisture. They may also produce glands in the forms of scales, different papills and, in roots, often they may function to absorb water and/or moisture.

A trichome may be formed by one cell or many cells.

The term "individualized trichome" as used herein means trichomes which have been artificially separated by a suitable method for individualizing trichomes from their host plant. In other words, individualized trichomes as used herein means that the trichomes become separated from a non-seed portion of a host plant by some non-naturally occurring action. In one example, individualized trichomes are artificially separated in a location that is sheltered from nature. Primarily, individualized trichomes will be fragments or entire trichomes with essentially no remnant of the host plant attached. However, individualized trichomes can also comprise a minor fraction of trichomes retaining a portion of the host plant still attached, as well as a minor fraction of trichomes in the form of a plurality of trichomes bound by their individual attachment to a common remnant of the host plant. Individualized trichomes may comprise a portion of a pulp or mass further comprising other materials. Other materials includes non-trichome-bearing fragments of the host plant.

In one example of the present invention, the individualized trichomes may be classified to enrich the individualized trichomal content at the expense of mass not constituting individualized trichomes.

Individualized trichomes may be converted into chemical derivatives including but not limited to cellulose derivatives, for example, regenerated cellulose such as rayon; cellulose ethers such as methyl cellulose, carboxymethyl cellulose, and hydroxyethyl cellulose; cellulose esters such as cellulose acetate and cellulose butyrate; and nitrocellulose. Individualized trichomes may also be used in their physical form, usually fibrous, and herein referred to "trichome fibers", as a component of fibrous structures.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are nonlimiting examples of seed hair fibers.

Further, trichome fibers are different from nonwood bast and/or core fibers in that they are not attached to the bast, also known as phloem, or the core, also known as xylem portions of a nonwood dicotyledonous plant stem. Nonlimiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers or synthetic fibers, or any other suitable fibers, and any combination thereof.

Natural fibrous structure-making fibers useful in the present invention include animal fibers, mineral fibers, other plant fibers (in addition to the trichomes of the present invention) and mixtures thereof. Animal fibers may, for example, be selected from the group consisting of: wool, silk and mixtures thereof. The other plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. Nos. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); and mixtures thereof.

The web (fibrous structure) of the present invention may comprise fibers, films and/or foams that comprises a hydroxyl polymer and optionally a crosslinking system. Nonlimiting examples of suitable hydroxyl polymers include polyols, such as polyvinyl alcohol, polyvinyl alcohol derivatives, polyvinyl alcohol copolymers, starch, starch derivatives, chitosan, chitosan derivatives, cellulose derivatives such as cellulose ether and ester derivatives, gums, arabinans, galactans, proteins and various other polysaccharides and mixtures thereof. For example, a web of the present invention may comprise a continuous or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer.

"Fiber Length", "Average Fiber Length" and "Weighted Average Fiber Length", are terms used interchangeably herein all intended to represent the "Length Weighted Average Fiber Length" as determined for example by means of a Kajaani FiberLab Fiber Analyzer commercially available from Metso Automation, Kajaani Finland. The instructions supplied with the unit detail the formula used to arrive at this average. The recommended method for measuring fiber length using this instrument is essentially the same as detailed by the manufacturer of the FiberLab in its operation manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, fiber length may be determined by sending the short fibers to a contract lab, such as Integrated Paper Services, Appleton, Wis.

Fibrous structures may be comprised of a combination of long fibers and short fibers.

Nonlimiting examples of suitable long fibers for use in the present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Nonlimiting examples of suitable short fibers suitable for use in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

Trichomes used in the present invention may include trichome fibers. The trichome fibers may be characterized as either long fibers or short fibers.

"Fibrous structure" as used herein means a structure that comprises one or more fibers. Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

"Sanitary tissue product" comprises one or more finished fibrous structures, converted or not, that is useful as a wiping implement for post-urinary and post-bowel movement cleaning (toilet tissue), for otorhinolaryngological discharges (facial tissue), and multi-functional absorbent and cleaning uses (absorbent towels).

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Dry Tensile Strength" (or simply "Tensile Strength" as used herein) of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

"Modulus" or "Tensile Modulus" as used herein means the slope tangent to the load elongation curve taken at the point corresponding to 15 g/cm-width upon conducting a tensile measurement as specified in the foregoing.

"Peak Load Stretch" (or simply "Stretch") as used herein is determined by the following formula:

$$\frac{\text{Length of Fibrous Structure}_{PL} - \text{Length of Fibrous Structure}_{I}}{\text{Length of Fibrous Structure}_{I}} \times 100$$

wherein:

Length of Fibrous $\text{Structure}_{PL}$ is the length of the fibrous structure at peak load;

Length of Fibrous $\text{Structure}_{I}$ is the initial length of the fibrous structure prior to stretching;

The Length of Fibrous $\text{Structure}_{PL}$ and Length of Fibrous $\text{Structure}_{I}$ are observed while conducting a tensile measurement as specified in the above. The tensile tester calculates the stretch at Peak Load. Basically, the tensile tester calculates the stretches via the formula above.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$ (20.3 $cm^2$). The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Apparent Density" or "Density" as used herein means the basis weight of a sample divided by the caliper with appropriate conversions incorporated therein. Apparent density used herein has the units $g/cm^3$.

Trichomes

Essentially all plants have trichomes. Those skilled in the art will recognize that some plants will have trichomes of sufficient mass fraction and/or the overall growth rate and/or robustness of the plant so that they may offer attractive agricultural economy to make them more suitable for a large commercial process, such as using them as a source of chemicals, e.g. cellulose, or assembling them into fibrous structures, such as disposable fibrous structures. Trichomes may have a wide range of morphology and chemical properties. For example, the trichomes may be in the form of fibers; namely, trichome fibers. Such trichome fibers may have a high length to diameter ratio.

The following sources are offered as nonlimiting examples of trichome-bearing plants (suitable sources) for obtaining trichomes, especially trichome fibers.

Nonlimiting examples of suitable sources for obtaining trichomes, especially trichome fibers, are plants in the Labiatae (Lamiaceae) family commonly referred to as the mint family.

Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

Additional examples of suitable species in the Labiatae family include the *arcticus* subspecies of *Thymus praecox*, commonly referred to as creeping thyme and the *pseudolanuginosus* subspecies of *Thymus praecox*, commonly referred to as wooly thyme.

Further examples of suitable species in the Labiatae family include several species in the genus *Salvia* (sage), including *Salvia leucantha*, commonly referred to as the Mexican bush sage; *Salvia tarahumara*, commonly referred to as the grape scented Indian sage; *Salvia apiana*, commonly referred to as white sage; *Salvia funereal*, commonly referred to as Death Valley sage; *Salvia sagittata*, commonly referred to as balsamic sage; and *Salvia argentiae*, commonly referred to as silver sage.

Even further examples of suitable species in the Labiatae family include *Lavandula lanata*, commonly referred to as wooly lavender; *Marrubium vulgar*, commonly referred to as horehound; *Plectranthus argentatus*, commonly referred to as silver shield; and *Plectranthus tomentosa*.

Nonlimiting examples of other suitable sources for obtaining trichomes, especially trichome fibers are plants in the Asteraceae family commonly referred to as the sunflower family.

Examples of suitable species in the Asteraceae family include *Artemisia stelleriana*, also known as silver brocade; *Haplopappus macronema*, also known as the whitestem goldenbush; *Helichrysum petiolare; Centaurea maritime*, also known as *Centaurea gymnocarpa* or dusty miller; *Achillea tomentosum*, also known as wooly yarrow; *Anaphalis margaritacea*, also known as pearly everlasting; and *Encelia farinose*, also known as brittle bush.

Additional examples of suitable species in the Asteraceae family include *Senecio brachyglottis* and *Senecio haworthii*, the latter also known as *Kleinia haworthii*.

Nonlimiting examples of other suitable sources for obtaining trichomes, especially trichome fibers, are plants in the Scrophulariaceae family commonly referred to as the figwort or snapdragon family.

An example of a suitable species in the Scrophulariaceae family includes *Pedicularis kanei*, also known as the wooly lousewort.

Additional examples of suitable species in the Scrophulariaceae family include the mullein species (*Verbascum*) such as *Verbascum hybridium*, also known as snow maiden; *Verbascum thapsus*, also known as common mullein; *Verbascum baldaccii; Verbascum bombyciferum; Verbascum broussa; Verbascum chaixii; Verbascum dumulsum; Verbascum laciniatum; Verbascum lanatum; Verbascum longifolium; Verbascum lychnitis; Verbascum olympicum; Verbascum paniculatum; Verbascum phlomoides; Verbascum phoeniceum; Verbascum speciosum; Verbascum thapsiforme; Verbascum virgatum; Verbascum wiedemannianum*; and various mullein hybrids including *Verbascum* 'Helen Johnson' and *Verbascum* 'Jackie'.

Further examples of suitable species in the Scrophulariaceae family include *Stemodia tomentosa* and *Stemodia durantifolia*.

Nonlimiting examples of other suitable sources for obtaining trichomes, especially trichome fibers include *Greyia radlkoferi* and *Greyia flanmaganii* plants in the Greyiaceae family commonly referred to as the wild bottlebrush family.

Nonlimiting examples of other suitable sources for obtaining trichomes, especially trichome fibers include members of the Fabaceae (legume) family. These include the *Glycine max*, commonly referred to as the soybean, and *Trifolium pratense* L, commonly referred to as medium and/or mammoth red clover.

Nonlimiting examples of other suitable sources for obtaining trichomes, especially trichome fibers include members of the Solanaceae family including varieties of *Lycopersicum esculentum*, otherwise known as the common tomato.

Nonlimiting examples of other suitable sources for obtaining trichomes, especially trichome fibers include members of the Convolvulaceae (morning glory) family, including *Argyreia nervosa*, commonly referred to as the wooly morning glory and *Convolvulus cneorum*, commonly referred to as the bush morning glory.

Nonlimiting examples of other suitable sources for obtaining trichomes, especially trichome fibers include members of the Malvaceae (mallow) family, including *Anoda cristata*, commonly referred to as spurred anoda and *Abutilon theophrasti*, commonly referred to as velvetleaf.

Nonlimiting examples of other suitable sources for obtaining trichomes, especially trichome fibers include *Buddleia marrubiifolia*, commonly referred to as the wooly butterfly bush of the Loganiaceae family; the *Casimiroa tetrameria*, commonly referred to as the wooly leafed sapote of the Rutaceae family; the *Ceanothus tomentosus*, commonly referred to as the wooly leafed mountain liliac of the Rhamnaceae family; the 'Philippe Vapelle' cultivar of *renardii* in the Geraniaceae (geranium) family; the *Tibouchina urvilleana*, commonly referred to as the Brazilian spider flower of the Melastomataceae family; the *Tillandsia recurvata*, commonly referred to as ballmoss of the Bromeliaceae (pineapple) family; the *Hypericum tomentosum*, commonly referred to as the wooly St. John's wort of the Hypericaceae family; the *Chorizanthe orcuttiana*, commonly referred to as the San Diego spineflower of the Polygonaceae family; *Eremocarpus setigerus*, commonly referred to as the doveweed of the Euphorbiaceae or spurge family; *Kalanchoe tomentosa*, commonly referred to as the panda plant of the Crassulaceae family; and *Cynodon dactylon*, commonly referred to as Bermuda grass, of the Poaceae family; and *Congea tomentosa*, commonly referred to as the shower orchid, of the Verbenaceae family.

Suitable trichome-bearing plants are commercially available from nurseries and other plant-selling commercial venues. For example, *Stachys byzantina* may be purchased and/or viewed at Blanchette Gardens, Carlisle, Mass.

In one example, a trichome suitable for use in the fibrous structures of the present invention comprises cellulose.

In yet another example, a trichome suitable for use in the fibrous structures of the present invention comprises a fatty acid.

In still another example, a trichome suitable for use in the fibrous structures of the present invention is hydrophobic.

Figure 2:
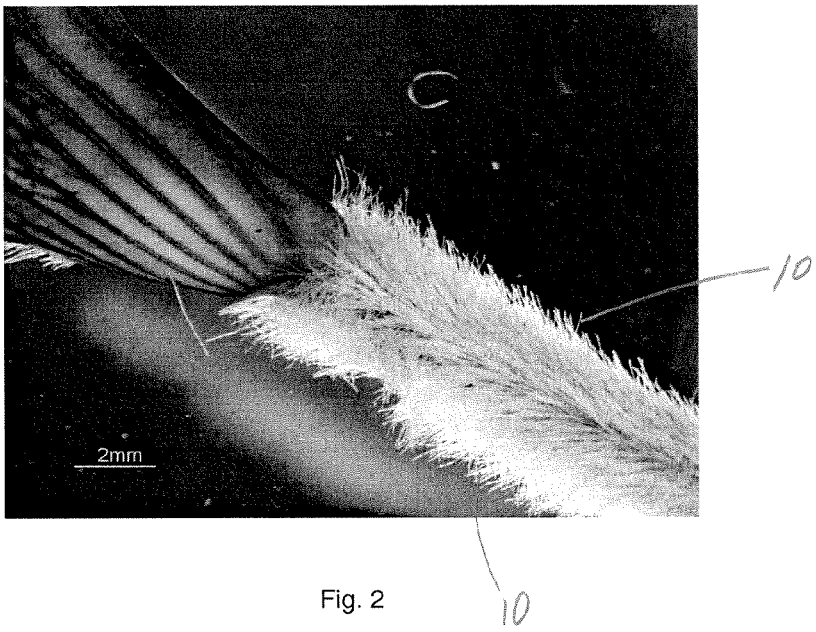
FIG. 2 is a light micrograph of a lower stem illustrating trichomes present on red clover, *Trifolium pratense* L.

As shown in FIG. 1, numerous trichomes 10 are present on this red clover leaf and leaf stem. FIG. 2 shows numerous trichomes 10 present on a red clover lower stem.

Figure 3:
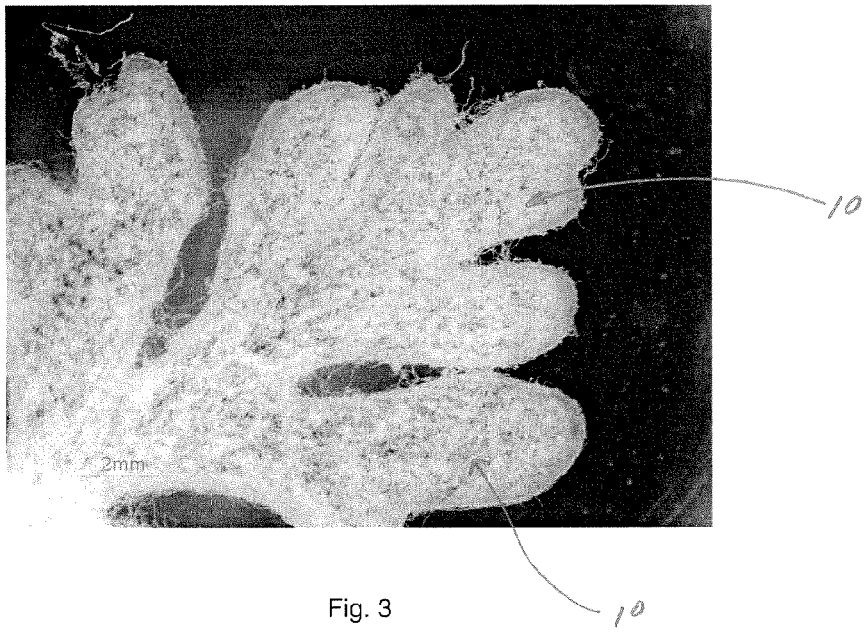
FIG. 3 is a light micrograph of a leaf illustrating trichomes present on dusty miller, *Centaurea gymnocarpa;*
Figure 4:
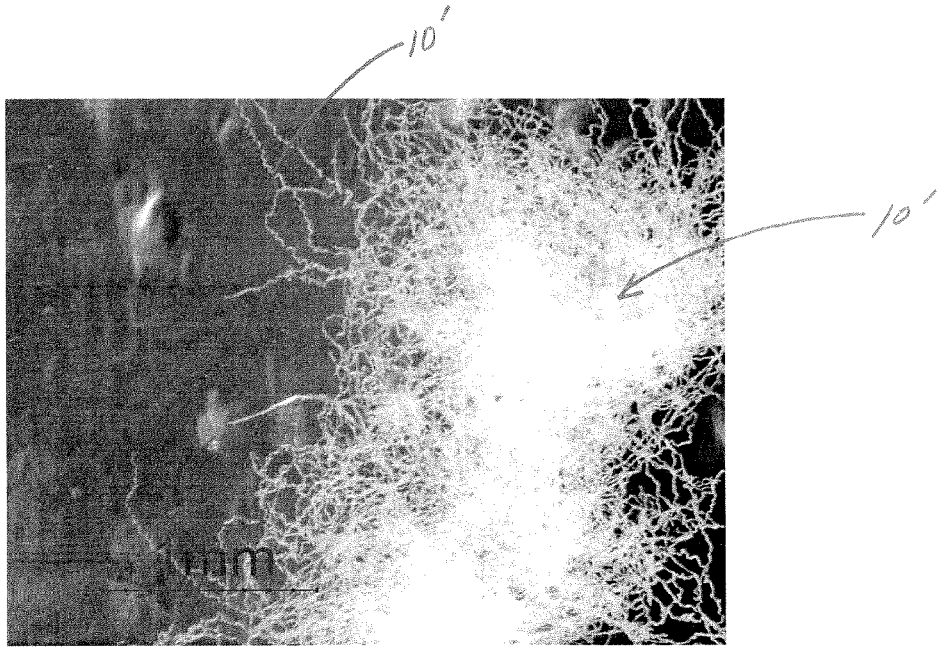
FIG. 4 is a light micrograph of individualized trichomes individualized from a leaf of dusty miller, *Centaurea gymnocarpa;*

As shown in FIG. 3, a dusty miller leaf is contains numerous trichomes 10. FIG. 4 shows individualized trichomes 10' obtained from a dusty miller leaf.

Figure 5:
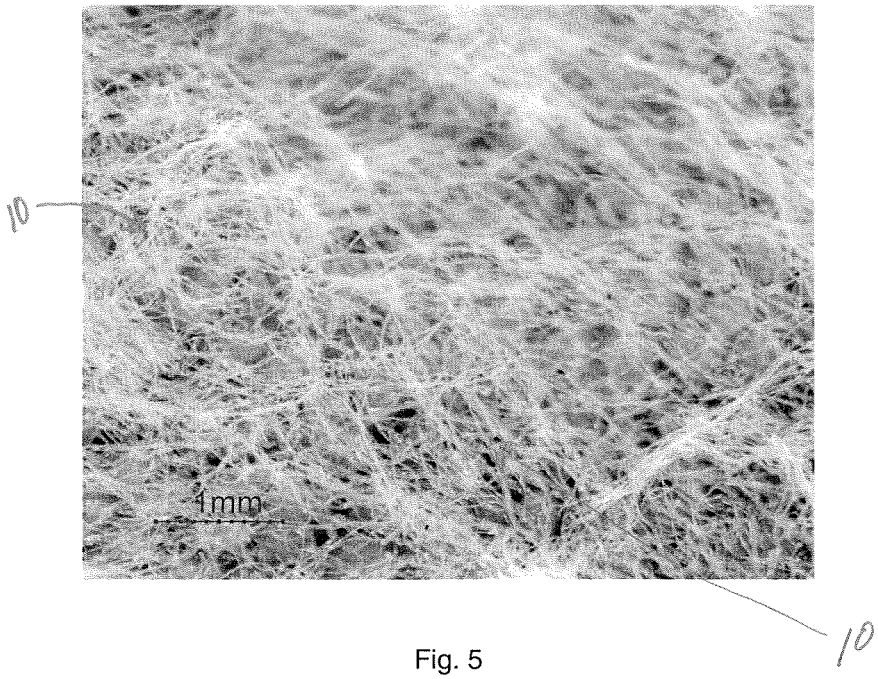
FIG. 5 is a light micrograph of a basal leaf illustrating trichomes present on silver sage, *Salvia argentiae;*
Figure 6:
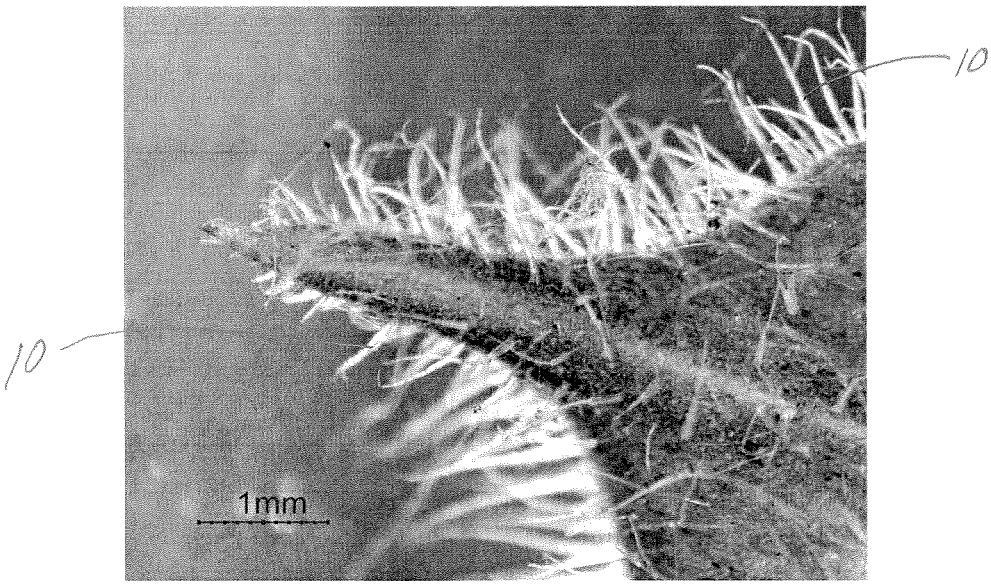
FIG. 6 is a light micrograph of a bloom-stalk leaf illustrating trichomes present in silver sage, *Salvia argentiae;*

As shown in FIG. 5, a basal leaf on a silver sage contains numerous trichomes 10. FIG. 6 shows trichomes 10 present on a bloom-stalk leaf of a silver sage.

Figure 7:
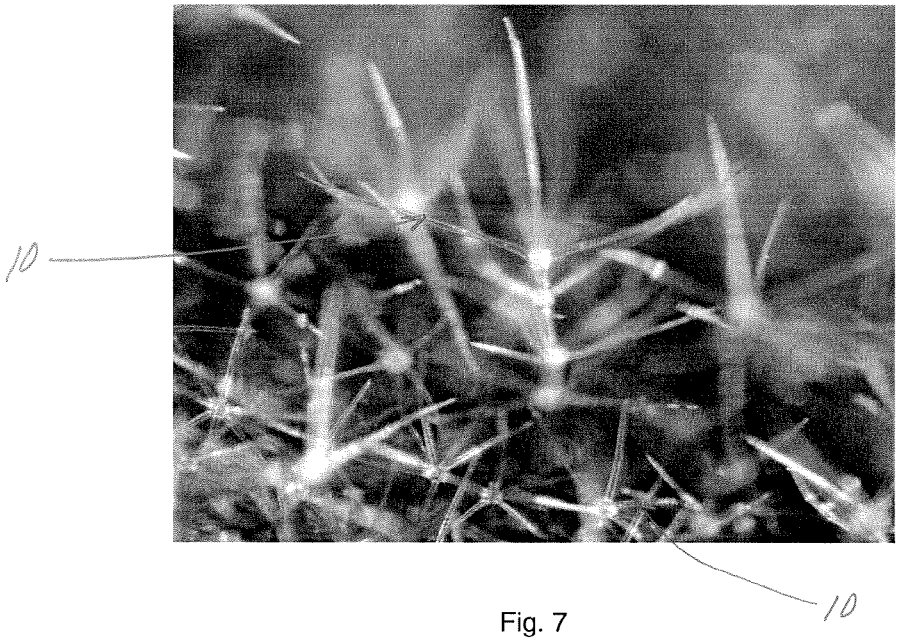
FIG. 7 is a light micrograph of a mature leaf illustrating trichomes present on common mullein, *Verbascum thapsus;*
Figure 8:
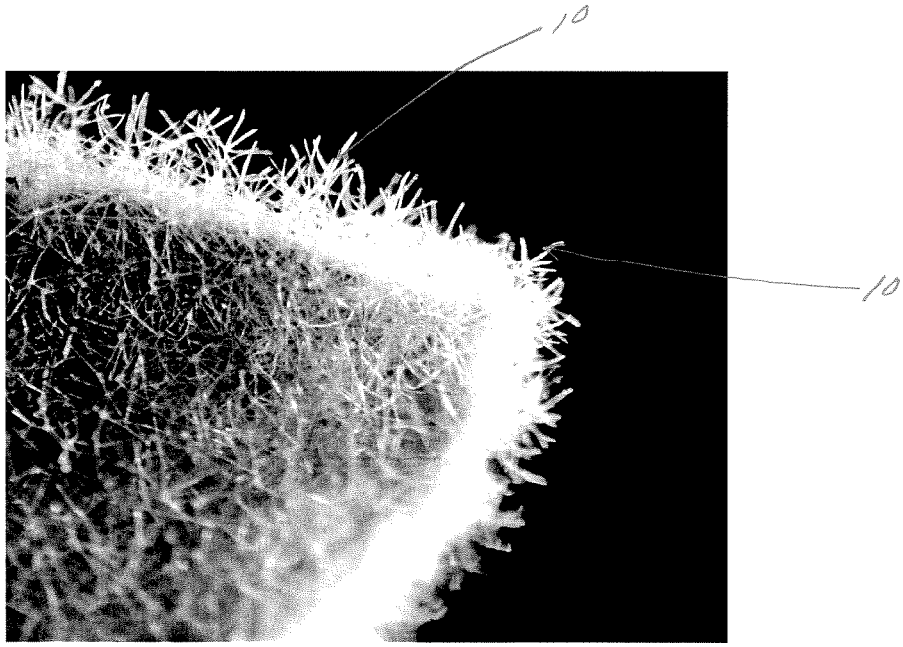
FIG. 8 is a light micrograph of a juvenile leaf illustrating trichomes present on common mullein, *Verbascum thapsus;*

As shown in FIG. 7, trichomes 10 are present on a mature leaf of common mullein. FIG. 8 shows trichomes 10 present on a juvenile leaf of common mullein.

Figure 9:
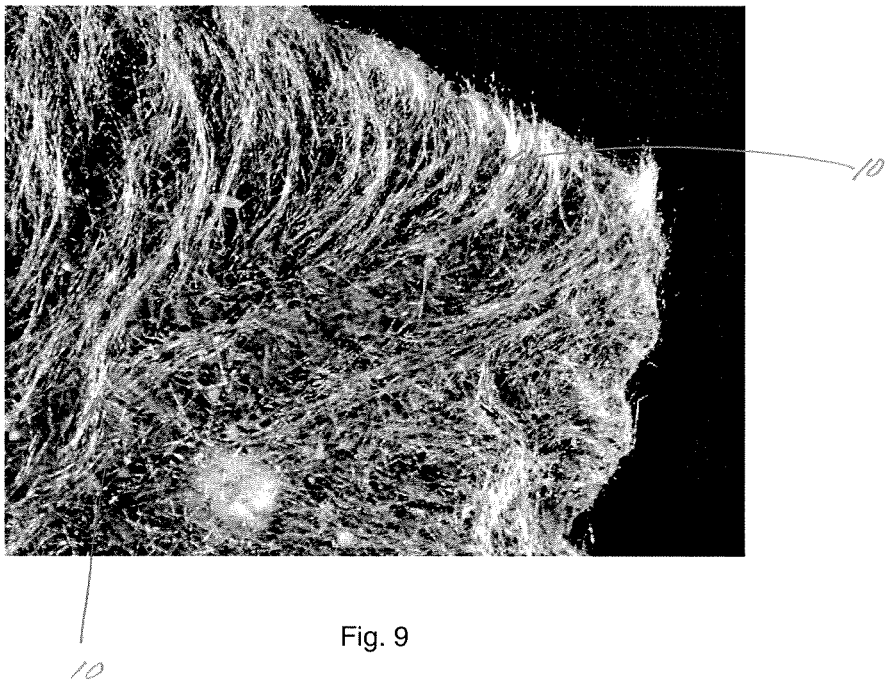
FIG. 9 is a light micrograph of a perpendicular view of a leaf illustrating trichomes present on wooly betony, *Stachys byzantina;*
Figure 10:
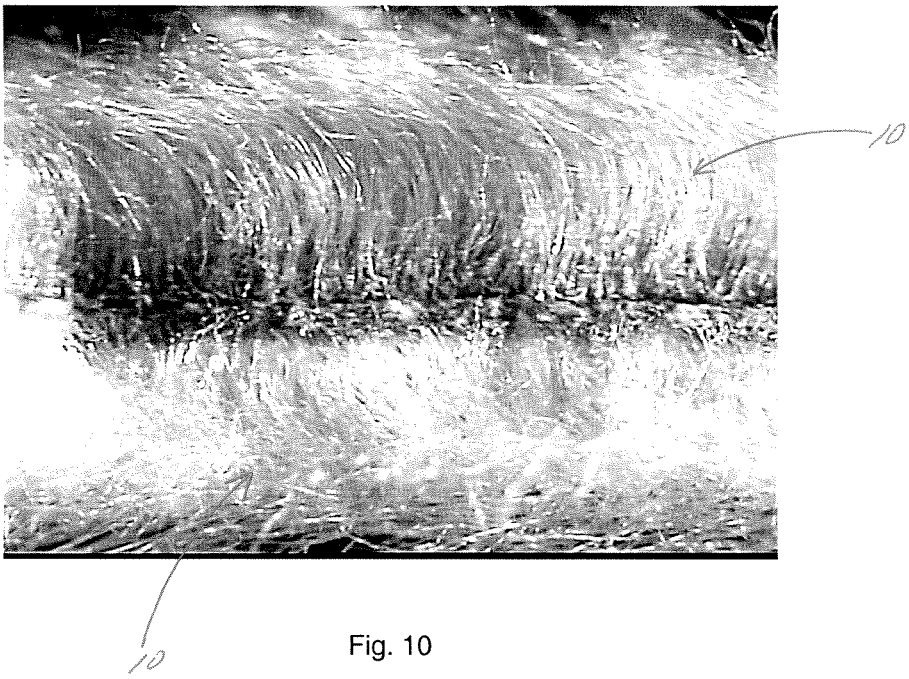
FIG. 10 is a light micrograph of a cross-sectional view of a leaf illustrating trichomes present on wooly betony, *Stachys byzantina.
Figure 11:
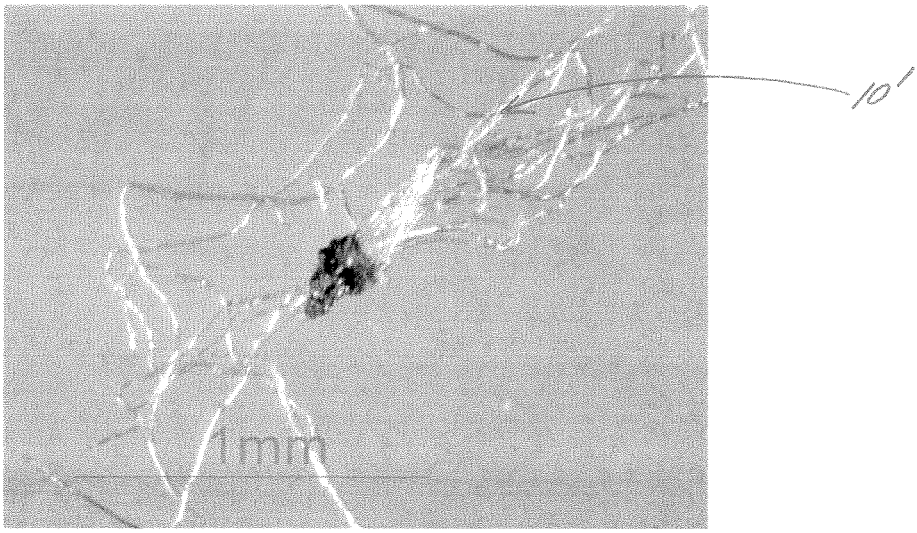
* and FIG. 11 is a light micrograph of individualized trichomes in the form of a plurality of trichomes bound by their individual attachment to a common remnant of a host plant, wooly betony, *Stachys byzantina.*

FIG. 9 shows, via a perpendicular view, trichomes 10 present on a leaf of wooly betony. FIG. 10 is a cross-sectional view of a leaf of wooly betony containing trichomes 10. FIG. 11 shows individualized trichomes 10' obtained from a wooly betony leaf Processes for Individualizing Trichomes Trichomes may be obtained from suitable plant sources by any suitable method known in the art. Nonlimiting examples of suitable methods include the step of separating a trichome from an epidermis of a non-seed portion of a plant.

Non-limiting examples of the step of separating include mechanical and/or chemical process steps.

Nonlimiting examples of mechanical process steps include contacting an epidermis of a non-seed portion of a trichome-bearing plant with a device such that a trichome is separated from the epidermis. Nonlimiting examples of such devices for use in such a contacting step include a ball mill, a pin mill, a hammermill, a rotary knife cutter such as a "Wiley Mill" and/or a "CoMil" sold by Quadro Engineering of Waterloo, Ontario, Canada.

In one example, an epidermis of a non-seed portion of a trichome-bearing plant is subjected to a mill device that comprises a screen, in particular, a slotted screen, designed to better separate the trichome-bearing material from the plant epidermis. In one example, the slots will be about 3 mm wide and/or the slots will be wider than about 0.5 mm and/or wider than about 1 mm and/or wider than about 2 mm. In another example, the slots will be narrower than about 6 mm and/or narrower than about 5 mm and/or narrower than about 4 mm. The slots can be of indefinite length. In one example, the slots have a length at least about 5 mm long and/or at least about 10 mm long and/or at least about 15 mm long.

After trichome-bearing material is subjected to the mechanical process to liberate them from the plant epidermis, it is preferred to enrich the pulp or fiber mass' content of individualized trichomes. This may be carried out by means of screening or air classifying equipment well known in the art. A suitable air classifier is the Hosokawa Alpine 50ATP, sold by Hosokawa Micron Powder Systems of Summit, N.J.

In one example, the pulp or fiber mass content of the individualized trichomes is subjected to one or more air classifying steps and then the pulp or fiber mass remaining after the air classifying step(s) is subjected to one or more screeners to further enrich the pulp or fiber mass' content of individualized trichomes.

Trichome material, before or after dry liberation from the host plant, i.e. creation of individualized trichomes, may be further subjected to chemical treatment to improve hydrophilicity, e.g. it may be treated with a surfactant or a polymer with surface active agent properties such EO-PO polymers sold under the trade name "PLURONIC" by BASF of Florham Park, N.J., or an ethyloxated polyester such as "Texcare 4060" sold by Clariant Inc. (Americas Div) of Wilmington, Del. Water dispersions of trichomes may be further treated with antifoam compounds to reduce their tendency to retain air and thus float. An example compound is "DC 2310", sold by Dow Corning of Midland, Mich. Additional treatments include extraction to remove certain hydrophobic components such as fatty acids. Such extraction may be done in aqueous, optionally hot aqueous, medium optionally containing surfactants to bind with and remove the hydrophobes. Non-aqueous or two phase systems may also be practiced, wherein the trichome hydrophobes are dissolved and/or dispersed in a non-water solvent and/or a non-water miscible solvent.

Alternatively, the creation of individualized trichomes may employ wet processes practiced on the trichome bearing plant, optionally in combination with mechanical treatment. This includes processes analogous to the well known (in the wood pulp industry) groundwood, refiner-mechanical pulping, or thermo-mechanical pulping means, followed optionally by wet classification to enrich the individualized trichomes. Wet processes also include chemical processes, nonlimiting examples of which include contacting an epidermis of a non-seed portion of a trichome-bearing plant with a chemical composition such that a trichome is separated from the epidermis. Suitable chemical process steps include the chemical process steps of the well-known (in the wood pulp industry) kraft, sulfite and/or soda processes, including chemi-mechanical variations.

In one example, a trichome is separated from a trichome-bearing plant by a method comprising the steps of: a) drying the trichome-bearing plant; b) contacting the trichome-bearing plant with a device such that the trichome is separated from the trichome-bearing plant's non-seed epidermis; and c) classifying the trichome from the trichome-bearing plant's chaff; and d) optionally, combusting the trichome-bearing plant's chaff; and e) using energy obtained from the combusting step d) for drying additional trichome-bearing plants in step a).

In one example, the dried trichome-bearing plant resulting from step a) comprises less than about 10% by weight of moisture.

Nonlimiting examples of suitable classifying equipment and/or processes include air classifiers and/or screen classifiers.

Non-limiting examples of chemical processes for liberating trichomes from a trichome-bearing plant include the well-known kraft, or sulfite, or soda processes.

Fibrous Structures

The fibrous structures of the present invention may comprise a trichome, especially a trichome fiber. In one example, a trichome fiber suitable for use in the fibrous structures of the present invention exhibit a fiber length of from about 100 μm to about 7000 μm and a width of from about 3 μm to about 30 μm.

In addition to a trichome, other fibers and/or other ingredients may also be present in the fibrous structures of the present invention.

Fibrous structures according to this invention may contain from about 0.1% to about 100% and/or from about 0.5% to about 50% and/or from about 1% to about 40% and/or from about 2% to about 30% and/or from about 5% to about 25% trichomes.

Nonlimiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

The fibrous structures and/or sanitary tissue products of the present invention may exhibit a basis weight of between about 10 g/m$^2$ to about 120 g/m$^2$ and/or from about 14 g/m$^2$ to about 80 g/m$^2$ and/or from about 20 g/m$^2$ to about 60 g/m$^2$.

The structures and/or sanitary tissue products of the present invention may exhibit a total (i.e. sum of machine direction and cross machine direction) dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structure and/or sanitary tissue products of the present invention may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The fibrous structures and/or sanitary tissue products of the present invention may exhibit a stretch at peak load (measured in direction of maximum stretch at peak load) of at least about 10% and/or at least about 15% and/or at least about 20% and/or from about 10% to about 70% and/or from about 10% to about 50% and/or from about 15% to about 40% and/or from about 20% to about 40%.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures comprising a trichome in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, nonwoven fibrous structures comprising synthetic or multicomponent fibers, homogeneous or multilayered fibrous structures, double re-creped fibrous structures, foreshortened fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

In addition to a trichome, the fibrous structure may comprise other additives, such as wet strength additives, softening additives, solid additives (such as starch, clays), dry strength resins, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such other additives may be added to the fiber furnish, the embryonic fibrous web and/or the fibrous structure.

Such other additives may be present in the fibrous structure at any level based on the dry weight of the fibrous structure.

The other additives may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention may be subjected to any suitable post processing including, but not limited to, printing, embossing, calendaring, slitting, folding, combining with other fibrous structures, and the like.

Processes for Making Trichome-Containing Fibrous Structures

Any suitable process for making fibrous structures known in the art may be used to make trichome-containing fibrous structures of the present invention.

In one example, the trichome-containing fibrous structures of the present invention are made by a wet laid fibrous structure making process.

In another example, the trichome-containing fibrous structures of the present invention are made by an air laid fibrous structure making process.

In one example, a trichome-containing fibrous structure is made by the process comprising the steps of: a) preparing a fiber furnish (slurry) by mixing a trichome with water; b) depositing the fiber furnish on a foraminous forming surface to form an embryonic fibrous web; and c) drying the embryonic fibrous web.

In one example, a fiber furnish comprising a trichome, such as a trichome fiber, is deposited onto a foraminuous forming surface via a headbox.

The following Example illustrates a nonlimiting example for the preparation of sanitary tissue product comprising a fibrous structure according to the present invention on a pilot-scale Fourdrinier fibrous structure making machine.

Individualized trichomes are first prepared from *Stachys byzantina* bloom stalks consisting of the dried stems, leaves, and pre-flowering buds, by passing dried *Stachys byzantina* plant matter through a knife cutter (Wiley mill, manufactured by the C. W. Brabender Co. located in South Hackensack, N.J.) equipped with an attrition screen having ¼" holes. Exiting the Wiley mill is a composite fluff constituting the individualized trichome fibers together with chunks of leaf and stem material. The individualized trichome fluff is then passed through an air classifier (Hosokawa Alpine 50ATP); the "accepts" or "fine" fraction from the classifier is greatly enriched in individualized trichomes while the "rejects" or "coarse" fraction is primarily chunks of stalks, and leaf elements with only a minor fraction of individualized trichomes. A squirrel cage speed of 9000 rpm, an air pressure resistance of 10-15 mbar, and a feed rate of about 10 g/min are used on the 50 ATP. The resulting individualized trichome material (fines) is mixed with a 10% aqueous dispersion of "Texcare 4060" to add about 10% by weight "Texcare 4060" by weight of the bone dry weight of the individualized trichomes followed by slurrying the "Texcare"-treated trichomes in water at 3% consistency using a conventional repulper. This slurry is passed through a stock pipe toward another stock pipe containing eucalyptus fiber slurry.

The aqueous slurry of eucalyptus fibers is prepared at about 3% by weight using a conventional repulper. This slurry is also passed through a stock pipe toward the stock pipe containing the trichome fiber slurry.

The 3% trichome slurry is combined with the 3% eucalyptus fiber slurry in a proportion which yields about 13.3% trichome fibers and 86.7% eucalyptus fibers. The stockpipe containing the combined trichome and eucalyptus fiber slurries is directed toward the headbox of a fourdrinier machine.

Separately, an aqueous slurry of NSK fibers of about 3% by weight is made up using a conventional repulper.

In order to impart temporary wet strength to the finished fibrous structure, a 1% dispersion of temporary wet strengthening additive (e.g., Parez® 750) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The trichome and eucalyptus fiber slurry is diluted with white water at the inlet of a fan pump to a consistency of about 0.15% based on the total weight of the eucalyptus and trichome fiber slurry. The NSK fibers, likewise, are diluted with white water at the inlet of a fan pump to a consistency of about 0.15% based on the total weight of the NSK fiber slurry. The eucalyptus/trichome fiber slurry and the NSK fiber slurry are both directed to a layered headbox capable of maintaining the slurries as separate streams until they are deposited onto a forming fabric on the Fourdrinier.

"DC 2310" antifoam is dripped into the wirepit to control foam to maintain whitewater levels of 10 ppm of antifoam.

The fibrous structure making machine has a layered headbox having a top chamber, a center chamber, and a bottom chamber. The eucalyptus/trichome combined fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus/trichome fibers and 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 12 mils above the supporting fabric. A suitable process for making the patterned drying fabric is described in U.S. Pat. No. 7,128,809.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 656 feet per minute. The fibrous structure may be subsequently converted into a two-ply sanitary tissue product having a basis weight of about 50 g/m$^2$.

The sanitary tissue paper product is very soft and absorbent.

All documents cited in the Detailed Description of the Invention are, in relevant part, incorporated herein by reference; the citation of any document is not to be construed as an admission that it is prior art with respect to the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method comprising forming a fibrous structure comprising an individualized trichome, wherein the individualized trichome is obtained from a bloom stalk of a plant in the Asteraceae family.

2. The method of claim 1, comprising forming a sanitary tissue product with the fibrous structure.

3. A method comprising forming a fibrous structure comprising an individualized trichome, wherein the individualized trichome is obtained from a non-seed portion of a plant in the Melastomataceae family.

4. The method of claim 3, comprising forming a sanitary tissue product with the fibrous structure.

* * * * *